US008660456B2

(12) United States Patent
Nishino et al.

(10) Patent No.: US 8,660,456 B2
(45) Date of Patent: Feb. 25, 2014

(54) IMAGING FORMING APPARATUS

(75) Inventors: Yoshiro Nishino, Toride (JP); Kenji Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 13/137,593

(22) Filed: Aug. 29, 2011

(65) Prior Publication Data

US 2012/0051778 A1 Mar. 1, 2012

(30) Foreign Application Priority Data

Aug. 30, 2010 (JP) ..... 2010-192813
Aug. 19, 2011 (JP) ..... 2011-179806

(51) Int. Cl.
*G03G 21/20* (2006.01)
*G03G 15/00* (2006.01)

(52) U.S. Cl.
USPC ..... 399/92; 399/94; 399/100

(58) Field of Classification Search
USPC ..... 399/92, 93, 94, 97, 107, 110; 361/676, 361/678
See application file for complete search history.

(56) References Cited

U.S. PATENT DOCUMENTS

2002/0173265 A1* 11/2002 Kipka et al. ..... 454/184
2004/0125349 A1* 7/2004 Ayash et al. ..... 355/30
2009/0116865 A1* 5/2009 Hanano ..... 399/92

FOREIGN PATENT DOCUMENTS

JP 58-217982 12/1983
JP 9-138629 5/1997
JP 09281825 A * 10/1997 ..... G03G 15/20
JP 2006138947 A * 6/2006

OTHER PUBLICATIONS

Machine translations of Tomatsu, JP 09-281825, and Hatori, JP 2006-138947.*

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

An image forming apparatus includes a main assembly, an image forming portion for forming a toner image using an electrophotographic process, an air supply opening for fluid communication between an inside and an outside of the main assembly, and an air supply device for supplying ambient air into the main assembly through the air supply opening. In addition, an exhausting device discharges air from inside of the main assembly, and a mounting portion selectively mounts, to the air supply opening, one of a cooling device for taking the ambient air in and for decreasing a temperature of the air taken in, and a cover for partly blocking the air supply opening and forming an air passage portion. When the cooling device is mounted to the mounting portion, the air supply device supplies the cooled air into the main assembly, and when the cover is mounted to the mounting portion, the air supply device supplies the ambient air directly into the main assembly through the air passage portion of the cover. When the cooling device is not mounted to the mounting portion, a control device continues air supply from the air supply opening irrespective of a detected temperature, and when the cooling device is mounted to the mounting portion, the control device controls on and off of the cooling device on the basis of an output of the detecting device, and on and off supply of air from the air supply opening in interrelation with the cooling device.

6 Claims, 10 Drawing Sheets

(a)

(b)

IMAGING FORMING APPARATUS

FIELD OF THE INVENTION AND RELATED ART

The present invention relates to an image forming apparatus such as a copying machine, a printer or the like using an electrophotographic type.

It relates more particularly to an image forming apparatus having a supply and exhaust system for cooling an inside of a main assembly of the apparatus.

In an image forming apparatus of an electrophotographic type, a toner image formed on an electrophotographic photosensitive member (photosensitive member) in an image forming portion is transferred onto a surface of the recording material such as recording paper directly or by way of an intermediary transfer member.

The toner image is fixed on the surface of the recording material by heating the recording material carrying the toner image by a fixing device.

The heat of the fixing device is not only applied to the recording material but also is radiated in the inside of the main assembly of the image forming apparatus, and therefore, the temperature of the image forming portion rises. In a developing device in the image forming portion, friction between the developer and constituent elements of the developing device produces frictional heat with the result of temperature rise of the developer. When the temperature in the developing device rises, the developer may be caked, or deterioration of the developer is promoted.

In view of this, the image forming apparatus is often equipped with a means for cooling the image forming portion and so on. Generally, in many cases, the use is made with a fan to take the ambient air, thus cooling the inside of the main assembly of the apparatus. In another example, a cooling device using heat of evaporation as in a refrigerator or air conditioner or a cooling device using the Peltier effect is used to supply the air having a temperature lower than that of the ambient air into the main assembly of the apparatus, thus reducing the temperature change in the neighborhood of the image forming portion.

By reducing the temperature change inside the main assembly of the apparatus, a variation in the magnification of the image can be suppressed, a variation in the coloring is suppressed, thus accomplishing the stabilization image qualities of the images.

Japanese Laid-open Patent Application Sho 58-217982 proposes that a cooler is provided on a side surface of the main assembly of the copying machine to introduce a cool air into the main assembly of the copying machine. Japanese Laid-open Patent Application Hei 9-138629 proposes that compressed air is fed by a compressor to a frame in the form of a pipe to supply the fresh ambient air to a plurality of constituent-elements.

SUMMARY OF THE INVENTION

However, the conventional structures involve the following problems.

In Japanese Laid-open Patent Application Sho 58-217982 and Japanese Laid-open Patent Application Hei 9-138629, the cooler and the compressor are standard, equipment of the main assembly of the apparatus. Therefore, the cost of the image forming apparatus increases, and the electric energy consumption thereof also increases.

The levels of the image qualities desired by individual users are different, and using manners such as the lengths of continuous operations of the image forming apparatuses are different, too. Therefore, the image forming apparatus may have excessive equipment, depending on the users.

Accordingly, it is a principal object of the present invention to provide an image forming apparatus, in which a cooling device can be easily mounted and demounted, so that the inside of the main assembly of the apparatus can be effectively cooled depending on the desire, substantially without changing the air flow inside the main assembly of the apparatus.

According to an aspect of the present invention, there is provided an image forming apparatus comprising a main assembly; an image forming portion, provided in said main assembly, for forming a toner image using an electrophotographic process; an air supply opening, provided in the main assembly, for fluid communication between an inside and an outside of said main assembly; an air supply device, provided in said main assembly, for supplying ambient air into said main assembly through said air supply opening; an exhausting device, provided in said main assembly, for discharging air from inside of said main assembly; a cooling device for taking the ambient air in and for decreasing a temperature of the air taken in, said cooling device is detachably mountable to said main assembly; and a cover for partly blocking said air supply opening and forming an air passage portion, said cover being detachably mountable to said main assembly, wherein said cover is selectively mounted to said air supply opening, and wherein when said cooling device is mounted to said air supply opening, said air supply device supplies the air supply device cooled by said cooling device into the main assembly; when said cover is mounted to said air supply opening, said air supply device supplies the ambient air directly into said main assembly through said air passage portion of said cover.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings.

Embodiment 1

Figure 1:
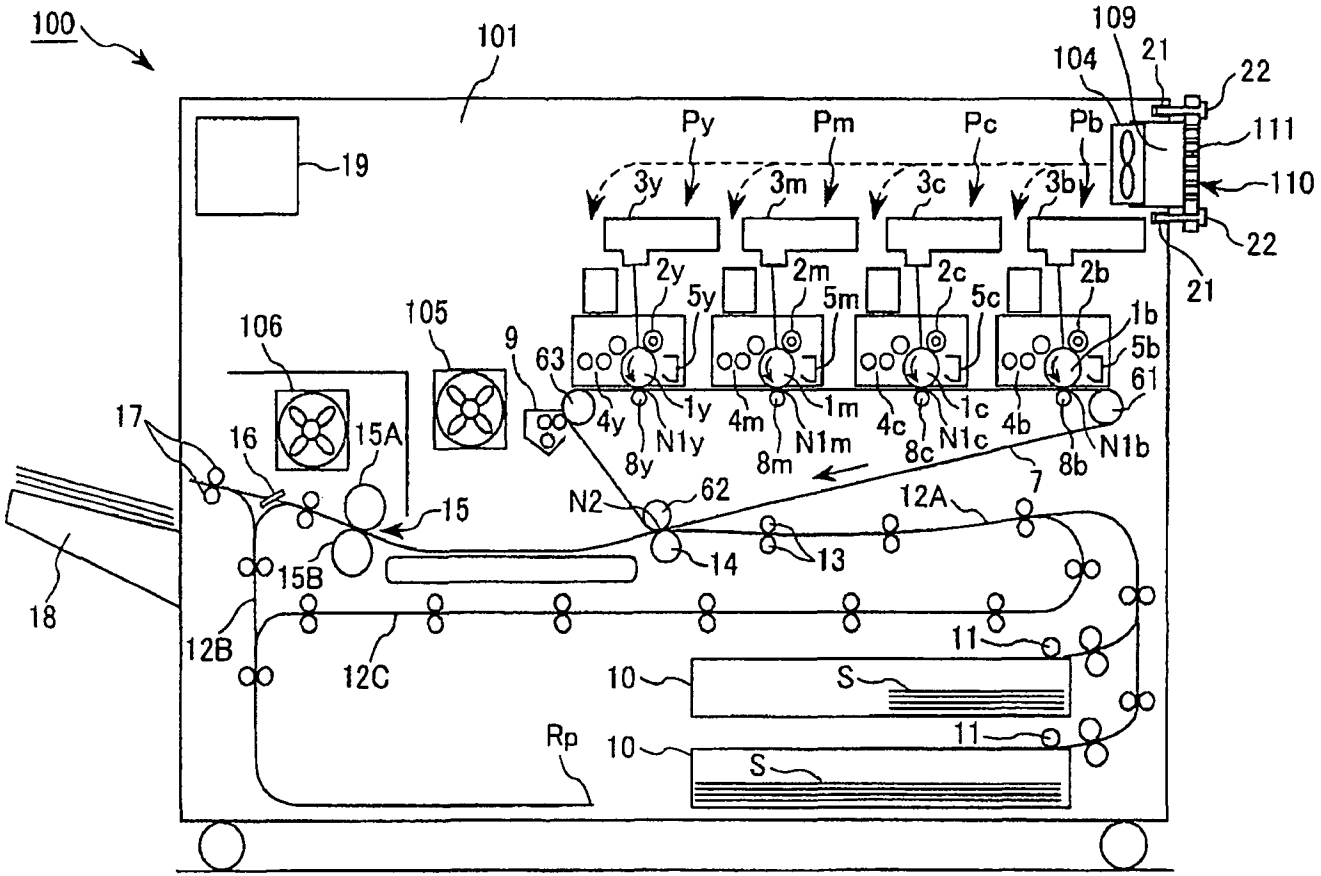
FIG. 1 is a schematic view illustrating a schematic structure of an image forming apparatus according to an embodiment of the present invention wherein a cover is mounted to air supply opening.

1. General Arrangement and Operation of Image Forming Apparatus:

FIG. 1 schematically shows a structure of an image forming apparatus in the state of standard equipment according to an embodiment of the present invention. The image forming apparatus 100 of this embodiment is a full color laser beam printer capable of forming a full-color image using an electrophotographic type.

A main assembly of the apparatus 101 of the image forming apparatus 100 is provided therein with first, second, third and fourth image forming portions Py, Pm, Pc, Pb as image forming portions. Each of the first, second, third and fourth image forming portions Py, Pm, Pc, Pb form yellow, magenta, cyan and black images through electrophotographic image forming processes each including charging, exposure and development steps. The image forming apparatus 100 comprises a controller 19 as control means in the main assembly of the apparatus 101 The controller 19 includes a CPU as calculation processing means and ROM and RAM as storing means When the controller 19 receives a print instructions signal outputted from an external device (not shown), the controller 19 operates the first, second, third and fourth image forming portion Py, Pm, Pc, Pb and so on in accordance with an image formation control sequence stored in the memory.

In this embodiment, the structures and operations of the first, second, third and fourth image forming portions Py, Pm, Pc, Pb are common in most respects. Therefore, in the following descriptions, subscripts y, m, c and b are omitted where the description applies commonly.

The image forming portion P comprises an electrophotographic photosensitive member, that is, a photosensitive drum 1 as an image bearing member. The photosensitive drum 1 is rotated in the direction indicated by the arrow (counterclockwise) in the Figure at a predetermined peripheral speed (process speed). Around the photosensitive drum 1, the following means are disposed in the order named along the rotational moving direction. The first is a charging roller 2 as charging means. The second is an exposure device (laser scanner) 3 as exposure means. The next is a developing device 4 as developing means. The next is a drum cleaner 5 as photosensitive member cleaning means.

An intermediary transfer belt 7 as an intermediary transfer member in the form of an endless belt is provided so as to oppose to the photosensitive drums 1*y*, 1*m*, 1*c*, 1*b* of the image forming portions Py, Pm, Pc, Pb. The intermediary transfer belt 7 extends around a driving roller 61, a follower roller 62 and a tension roller 63 and is rotated by the driving roller 61 in the direction indicated by the arrow (clockwise) in the Figure at a peripheral speed corresponding to the peripheral speed of the rotation of the photosensitive drums 1. Inside the intermediary transfer belt 7, there are provided primary transfer rollers 8*y*, 8*m*, 8*c*, 8*b* as primary transfer members as primary transferring means so as to oppose the photosensitive drums 1*y*, 1*m*, 1*c*, 1*b*, respectively with the intermediary transfer belt 7 interposed therebetween. Each of primary transfer rollers 8 is urged toward the associated photosensitive drum 1 through the intermediary transfer belt 7 to form a primary transfer portion (primary transfer nip) N1*y*, N1*m*, N1*c*, N1*b* where the photosensitive drum 1 and the intermediary transfer belt 7 contact to each other. Out side of the intermediary transfer belt 7, there is provided a secondary transfer roller 14 as secondary transfer member as secondary transferring means so as to oppose the follower roller 62. The secondary transfer roller 14 is urged toward the follower roller 62, through the intermediary transfer belt 7 to form a secondary transfer portion (secondary transfer nip) N2 where the intermediary transfer belt 7 and the secondary transfer roller 14 contact to each other.

In the image forming operation in each image forming portion P, the outer surface (surface) of the photosensitive drum 1 is charged uniformly by the charger 2 to a predetermined polarity and potential. The surface of the photosensitive drum 1 thus charged is exposed to and scanned with a laser beam generated on the basis of image information from an external device by an exposure device 3. By this, an electrostatic latent image (electrostatic image) is formed in accordance with the image information on the surface of the photosensitive drum 1. The electrostatic latent image is developed with toner by the developing device 4 so that a toner image is formed on the surface of the photosensitive drum 1.

In this embodiment, the developing device 4 is a two component developing type device using a two component developer (developer) which is a mixture mainly of non-magnetic toner particles (toner) and magnetic carrier particles (carrier). The developing device 4 includes a developing container accommodating the developer, a developing sleeve as developer carrying member for carrying and feeding the developer to an opposing portion where it is opposed to the photosensitive drum 1, and a feeding screw as developer feeding member for feeding the developer from the developing container to the developing sleeve. In this embodiment, the developing device 4 transfers the toner charged to the same polarity as the charge polarity of the photosensitive drum 1 from the developer carried on the developing sleeve to the such portions of the surface of the charged photosensitive drum 1 where the charge is attenuated by the exposure.

For example, for the formation of a full-color image, the above-described charging, exposure and development are carried out in the first, second, third and fourth image forming portions Py, Pm, Pc, Pb, respectively. The toner images of respective colors formed on the surface of, the photosensitive drums 1 in the image forming portions P are transferred (primary transfer) in the primary transfer portions N1 by the primary transfer rollers 8 superimposedly onto the outer surface of the intermediary transfer belt 7. By this, a full-color toner image is formed on the surface of the intermediary transfer belt 7.

The toner (primary untransferred toner) remaining on the surface of the photosensitive drum 1 after the primary transfer step is removed by the drum cleaner 5 and is collected. The photosensitive drum 1 is then prepared for the next image forming operation.

On the other hand, a recording material S is fed out of the feeding cassette 10 by the delivery roller 11 and is fed to registration rollers 13 along the feeding path 12A. Then, the recording material S is fed to the secondary transfer portion N2 which is between the intermediary transfer belt 7 and the secondary transfer roller 14, by the registration roller 13. Then, the toner image on the surface of the intermediary transfer belt 7 is transferred (secondary transfer) onto the recording material S in the process of feeding the recording material S while nipping it between the intermediary transfer belt 7 and the secondary transfer roller 14 in the secondary transfer nip N2.

The toner (after-secondary-transfer residual toner) remaining on the surface of the intermediary transfer belt 7 after the secondary transfer step is removed and collected by a belt cleaner 9 as intermediary transfer member cleaning means. Then, the intermediary transfer belt 7 is prepared for the next image forming operation.

The recording material S onto which the toner image has been transferred is fed to a heating and pressing type fixing device 15 as fixing means. The fixing device 15 includes a heating roller 15A provided with a heat source and a pressing roller 15B press-contacted to the heating roller 15A. The recording material S carrying the unfixed toner image is introduced with the image carrying side up into the nip (contact region) formed by the heating roller 15A and the pressing roller 15B in the fixing device 15 The recording material S is nipped and fed between the heating roller 15A and the pressing roller 15B, by which it is heated and pressed so that the toner image is formed thereon.

In the case that the image is formed only on one side of the recording material S, the recording material S discharged from the fixing device 15 is guided by the flapper 16 to the discharging roller 17, and is discharged onto the discharging tray 18 provided on a side surface of the main assembly of the apparatus 101.

In the case that the images are formed on both sides of the recording material P, the recording material S discharged from the fixing device 15 is guided by switching flapper 16 to the reverse feeding path 12B provided below. In the reverse feeding path 12B, when the trailing edge of the recording material S reaches a reversion point Rp, the recording material is switchbacked, so that it is fed to a feeding path 12C for the both-sided print with the image carrying side face up. Thereafter, the recording material S is fed out of the feeding path 12C to the registration roller 13 along the feeding path 12A. Then, the recording material S is fed to the secondary transfer portion N2 by the registration roller 13 so that a toner image is transferred in the secondary transfer portion N2. Thereafter, the recording material S carrying the unfixed toner image is introduced to the fixing device 15 with the image carrying side facing up, and the toner image is fixed on the recording material. Then, the recording material P discharged from the fixing device 15 is guided to the discharging roller 17 by the flapper 16 and is discharged onto the discharging tray 18 by the discharging roller 17.

2. Supply and Exhaust System:

The description will be made as to a supply and exhaust system which the image forming apparatus 100 is provided within this embodiment.

The main assembly 101 of the image forming apparatus 100 is provided with air supply opening 109 for fluid communication between the inside and the outside. The main assembly 101 of the image forming apparatus 100 is further provided with suction fan 104 as air supply means for supplying the ambient air main assembly of the apparatus 101 through the air supply opening 109. The main assembly 101 of the image forming apparatus 100 is further provided with an exhaust fan 105 as exhausting means for discharging the air from the inside of the main assembly of the apparatus 101 to an outside. A cooling device 102 (FIG. 4) and a cover 110 (FIG. 1) are selectively mountable to the common said air supply opening 109. The cooling device 102 functions to take the ambient air in and cool it, and is detachably mountable relative to the main assembly 101 of the apparatus. The cover 110 partially close the air supply opening 109 leaving air passage portions 111 for permitting passage of the air, and is detachably mountable relative to the main assembly of the apparatus 101, and the cover 110 enables to introduce the ambient air into the main assembly of the apparatus 101 through the air passage portion 111.

It is effective to prevent the user from touching the air supply fan 104 from the outside.

The cooling device 102 and the cover 110 are selectively connected to a common connecting portion 21 of the main assembly of the apparatus 101. The connecting portion 21 may be a screw bore engageable with a volt as fixing means for fixing the cooling device 102 the cover 110 to the main assembly of the apparatus 101. In this embodiment, the cooling device 102 is mounted to the air supply opening 109 through a connection duct 103 which is detachably mountable relative to the main assembly of the apparatus 102 and which is effective to connect the air supply opening 109 and the cooling device 102 with each other.

When the cooling device 102 is mounted to the air supply opening 109, the air supply fan 104 supplies the ambient air cooled by the cooling device 102 into the main assembly of the apparatus 101. On the other hand, when the cover 110 is mounted to the air supply opening 109, the air supply fan 104 supplies the ambient air directly into the main assembly of the apparatus 101 through the air passage portion 111 of the cover 110.

According to this embodiment, the flow path of the air from the air supply fan 104 to the exhaust fan 105 in the main assembly of the apparatus 101 is common irrespective of which of the cooling device 102 or the cover 110 is mounted to the air supply opening 109.

Thus, according to this embodiment, the air supply opening 109 is used both for taking the cool air in when the cooling device 102 is mounted and for taking the ambient air in when the cooling device 102 is not mounted. Therefore, the cooling device 102 can be mounted without changing the air flow in the main assembly of the apparatus 101, depending on the desire of the user.

For example, for the user operating the image forming apparatus for long hours, the advantage of the cooling device 102 can be provided, and for the user not operating it for long hours, the operation of the low cost, low electric energy consumption and simple structure can be provided. The description will be made in more detail.

3. Standard Equipment

The supply and exhaust system which is a standard equipment of the image forming apparatus 100 will be described. With the standard equipment, the cover 110 rather than the cooling device 102 is mounted to the air supply opening 109.

Figure 2:
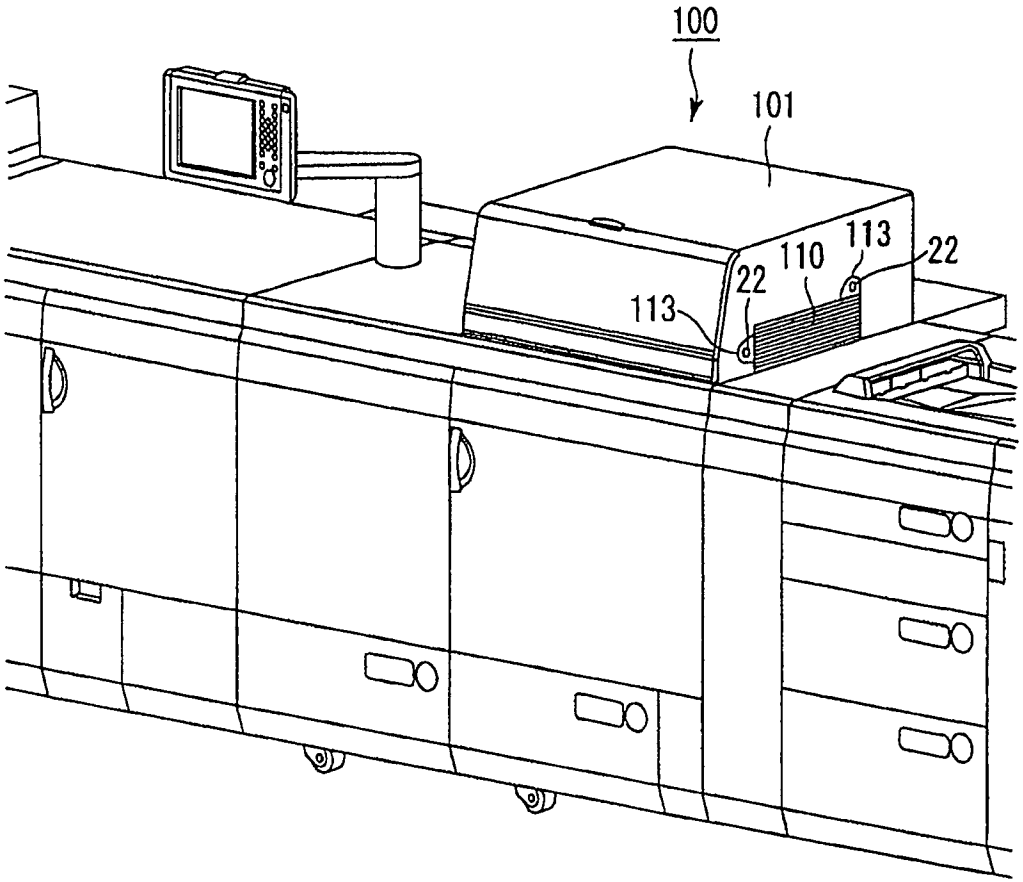
FIG. 2 is a perspective view of an outer appearance of a front side of the image forming apparatus wherein the cover is mounted to the air supply opening in the embodiment.

FIG. 2 illustrates an outer appearance of a front side of the image forming apparatus 100 with the standard equipment. The front side of the image forming apparatus 100 which is seen in the Figure will be forward or front side, and the opposite side will be called back or rear side.

The air supply opening 109 is disposed above the image forming portions Py, Pm, Pc, Pb of the image forming apparatus 100. In this embodiment, the air supply opening 109 is disposed in an upper right front part of the main assembly of the apparatus 101 as seen from the front side of the image forming apparatus 100. In addition, the air supply fan 104 is disposed above the image forming portions Py, Pm, Pc, Pb. In addition, in this embodiment, the air supply fan 104 is disposed in an upper right front part of the main assembly of the apparatus as seen from the front side of the image forming apparatus 100 and adjacent a portion above the fourth image forming portion Pb. The air supply opening 109 is provided in an outer casing portion of the main assembly of the apparatus 101 outside the air supply fan 104. The cover 110 is mounted to cover the air supply opening 109. In this embodiment, an outer casing portion of the main assembly of the apparatus 101 adjacent the air supply opening 109 is provided with a screw bore 21 as the connecting portion. The cover 110 is fastened to the main assembly of the apparatus 101 by screwing the volt 22 as fixing means through the mounting hole 114 (which will be described hereinafter) into the screw bore 21. In the standard equipment, the ambient air is taken directly into the main assembly 101 to cool the inside of the main assembly of the apparatus 101.

Figure 3:
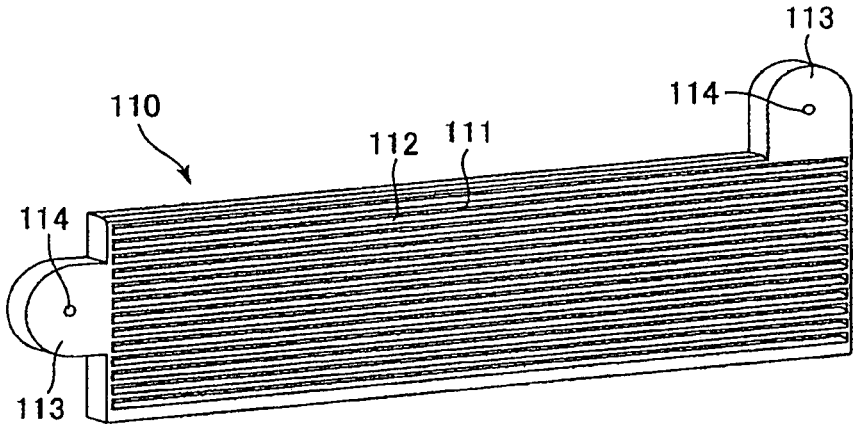
FIG. 3 is a perspective view showing an example of the cover mounted to the air supply opening of the image forming apparatus in the embodiment.
Figure 3:
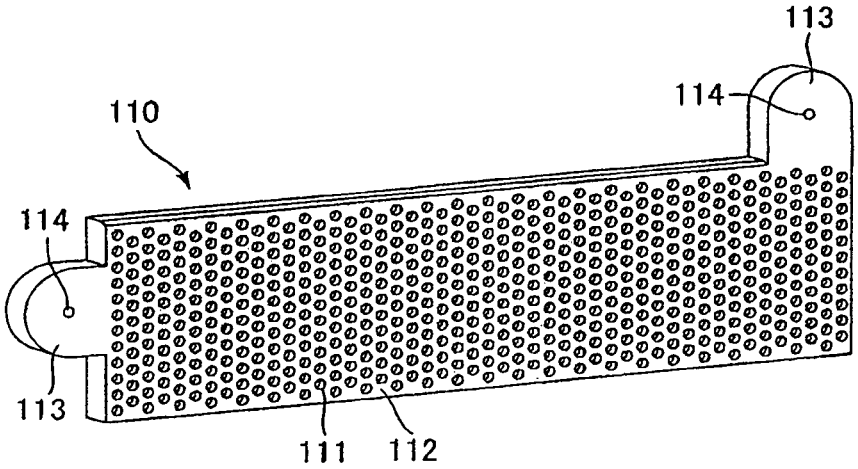

Parts (a) and (b) of FIG. 3 show outer appearances of the cover 110. Either one is usable. In this embodiment, the cover 110 is a plate-like member which is generally rectangular, and it has a block portion 112 which partially blocks the air and the air supply opening 109 which permits the fluid communication between the inside and the outside of the cover 110. The cover 110 shown in part (a) of FIG. 3 is provided with a louver having air passage portions 111 extending substantially parallel with the may body of the cover. The cover 110 shown in part (b) of FIG. 3 is provided with punched holes (air passage portions 111). The configuration of the cover 110 is not limited to those shown in FIG. 3.

The cover 110 has mounting portions 113, 113 for fixed the cover 110 to the main assembly of the apparatus 101 at the opposite longitudinal end portions. In this embodiment, one of the mounting portions 113 is projected from a side surface of the rectangular plate-like cover, and the other mounting portion 113 is projected from an end of the rectangular plate-like cover. The mounting portions 113, 113 have mounting holes 114, 114 through which the bolts 22 are penetrated. When the cover 110 is fixed to the main assembly of the apparatus 101, the bolt 22 is penetrated through the hole 114 and screwed into the outer casing portion of the main assembly of the apparatus 101, thus fastening the cover 110 to the outer casing portion.

In this embodiment, the air supply opening 109 and the air supply fan 104 are disposed above the image forming portions Py, Pm, Pc, Pb, as described above. The ambient air fed into the main assembly of the apparatus 101 is lower in the temperature than the inside of the main assembly of the apparatus 101. The ambient air taken into the main assembly of the apparatus 101 by the air supply fan 104 through the air passage portion 111 of the cover 110 and the air supply opening 109 reaches the photosensitive drum 1 and the circumference of the developing device 4 through the gaps between the image forming portions Py, Pm, Pc, Pb, as shown in a broken line arrow in FIG. 1.

On the other hand, the main assembly 101 of the image forming apparatus 100 is provided with an exhaust fan 105 at a level equal to lower than the image forming portions Py, Pm, Pc, Pb. In this embodiment, the exhaust fan 105 is disposed at a rear part of the main assembly of the apparatus 101 in the neighborhood below the first image forming portion Py which is disposed opposite the air supply fan 104 with the image forming portions Py, Pm, Pc, Pb interposed therebetween. The exhaust fan 105 discharges the air having flown through the gaps between the image forming portions Py, Pm, Pc, Pb to the outside of the main assembly of the apparatus 101.

In this manner, in this embodiment, in the main assembly of the apparatus 101, the air supply fan 104 is remoter than the exhaust fan 105 from the fixing device 15. More particularly, the air supply, fan 104 is disposed at a position remotest from the fixing device 15 which is a maximum heat generation source in the main assembly of the apparatus 101, and the exhaust fan 105 is disposed adjacent to the fixing device 15. In this embodiment, the fixing device 15 is disposed below the image forming portions P.

In this embodiment, there is provided an additional fan, that is, a heat removing fan 106 for effectively discharging the air in the neighborhood of the fixing device 15 to an outside of the main assembly of the apparatus 101. In this embodiment, the heat removing fan 106 is disposed at a rear part of the main assembly of the apparatus 101 at a position closer to the fixing device 15 than the exhaust fan 105.

The air raised in the temperature by the fixing device 15 has a lower density, and therefore, moves upwardly against the gravity. Therefore, the heat removing fan 106 as heat removing means in this embodiment is disposed at least below the image forming portion, particularly below the developing device. In order to effectively remove the rising heated air, it is preferable that the exhaust fan 106 is substantially at the same level or higher than the fixing device 15 with respect to the direction of gravity at the rear side.

When the heat removing fan 106 is disposed at the same level as or below the image forming portions Py, Pm, Pc, Pb, the heat removing fan 106 also functions as an exhausting means similarly to the exhaust fan 105.

According to the supply and exhaust system described above, the air flow around the image forming portion P is directed from the fourth image forming portion Pb to the first image forming portion Py and from the front side to the rear side. By doing so, the heat of the fixing device 15 is not easily imparted to the image forming portions P.

4. Option Device:

The description will be made as to a supply and exhaust system in the option device for the image forming apparatus 100. In the option device, a cooling device 102 not the cover 109 is mounted to the air supply opening 109.

Figure 4:
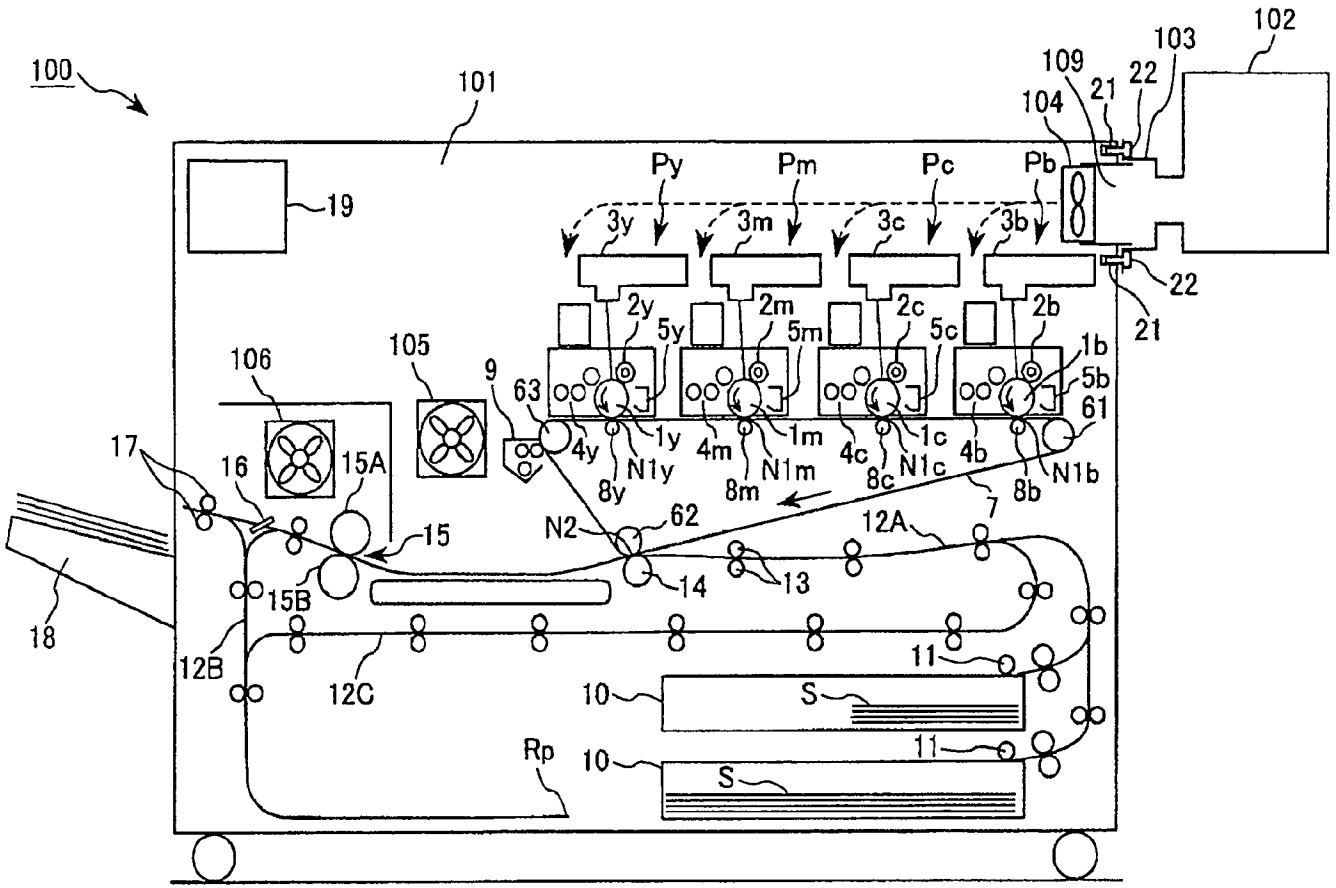
FIG. 4 is a schematic view illustrating a structure of the image forming apparatus wherein a cooling device is mounted to the air supply opening.
Figure 5:
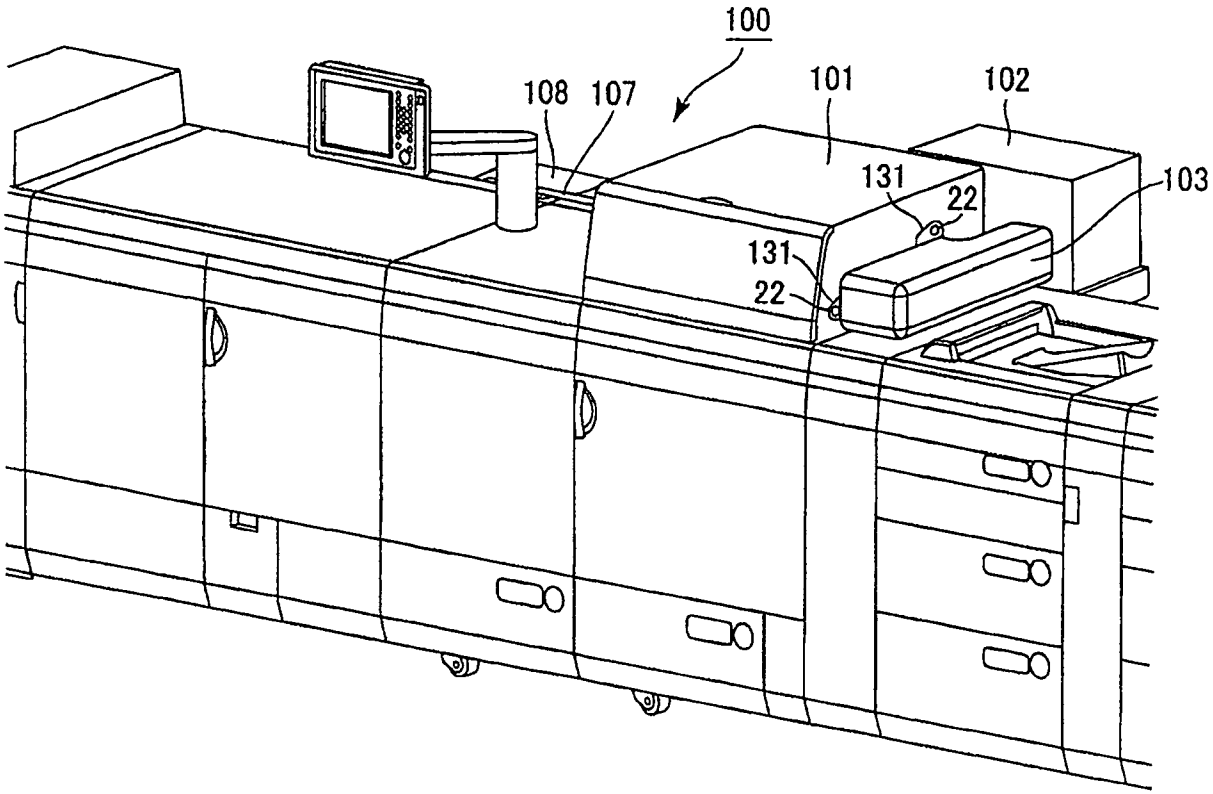
FIG. 5 is a perspective view of an outer appearance of a front side of the image forming apparatus wherein the cooling device is mounted to the air supply opening in the embodiment.
Figure 6:
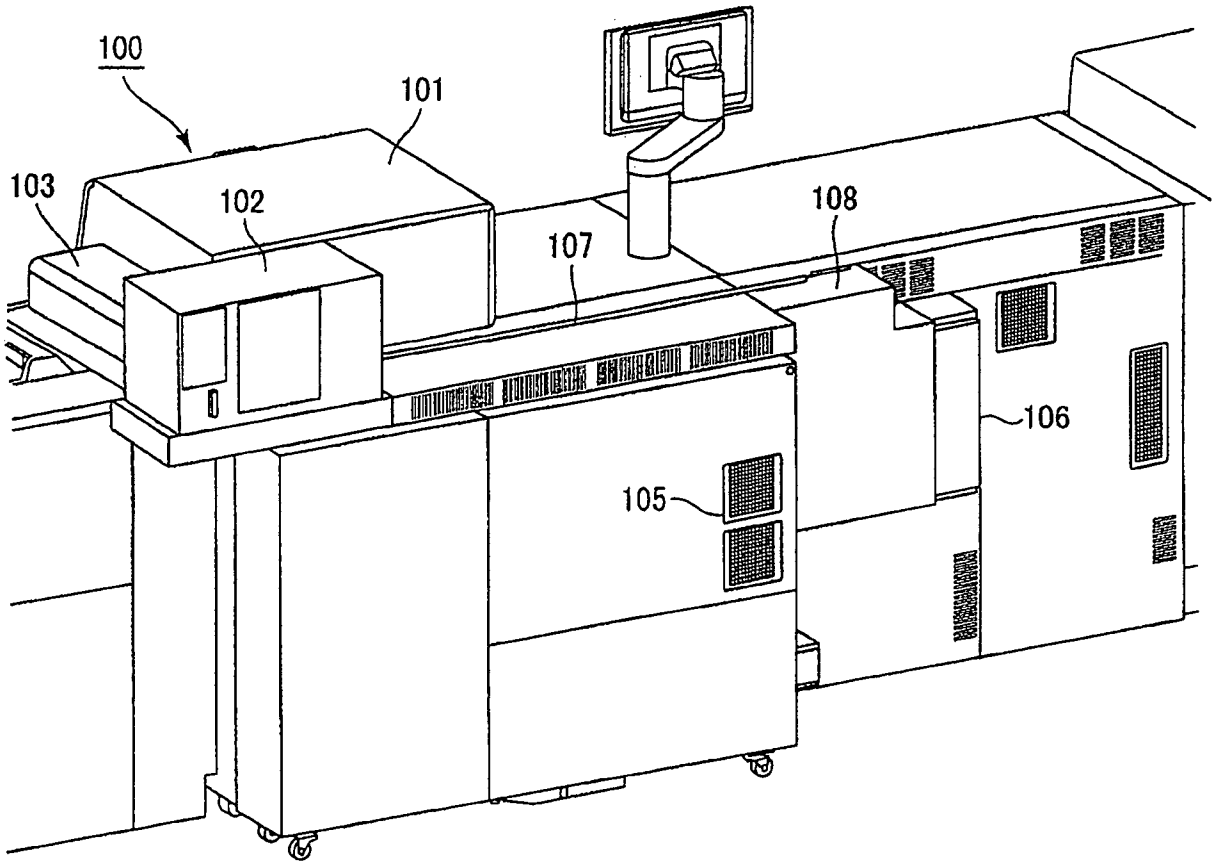
FIG. 6 is a perspective view of an outer appearance of a rear surface of the image forming apparatus wherein cooling device is mounted to the air supply opening in the embodiment.

FIG. 4 shows schematically an image forming apparatus 100 according to this embodiment to which the cooling device 102 is mounted to the air supply opening 109 as an option device. FIG. 5 shows an outer appearance of a front side of the image forming apparatus 100 having the option device. FIG. 6 shows an outer appearance of the image forming apparatus 100 having the option device.

In the option device, in the standard equipment, the cover 110 is dismounted from the air supply opening 109, and the cooling device 102 is mounted. In this embodiment, the cooling device 102 is mounted to the connecting portion 21 through the connection duct 103. One of the ends of the connection duct 103 is provided with a mounting portion 131 and a mounting hole (not shown) at positions corresponding to the mounting portion 113 and the mounting hole 114 which are provided on the cover 110. The connection duct 103 is fixed to the main assembly of the apparatus 101 by screwing the bolt 22 through the mounting hole 132 into the screw bore 21 provided in the main assembly of the apparatus 101. The other end of the connection duct 103 is fixed to the cooling device 102.

More particularly, the main assembly 101 of the image forming apparatus 100 is provided with an air supply opening 109 at a position above the image forming portions Py, Pm, Pc, Pb. In this embodiment, the air supply opening 109 is disposed in an upper right front part of the main assembly of the apparatus 101 as seen from the front side of the image forming apparatus 100. In addition, the air supply fan 104 is disposed above the image forming portions Py, Pm, Pc, Pb. In addition, in this embodiment, the air supply fan 104 is disposed in an upper right front part of the main assembly of the apparatus as seen from the front side of the image forming apparatus 100 and adjacent a portion above the fourth image forming portion Pb. The image forming apparatus 100 is provided with the cooling device 102 in the main assembly of the apparatus 101, and the cooling device 102 is disposed above the image forming portions Py, Pm, Pc, Pb. In this embodiment, the cooling device 102 is disposed at an upper right position and at the rear part as seen from the front side of the image forming apparatus 100. A connection duct 103 as connecting means connecting the cooling device 102 and the main assembly of the apparatus 101 with each other is provided at an upper right position as seem from the front side of the image forming apparatus 100.

The cool air is supplied by the air supply fan 104 provided inside of the connecting portion between the connection duct 103 and the air supply opening 109, through the connection duct 103 from the cooling device 102. The cool air fed to the inside of the main assembly of the apparatus 101 reaches the photosensitive drum 1 and the neighborhood of the developing device 4 through the gaps between the image forming portions Py, Pm, Pc, as indicated by a broken line in FIG. 1. In the option device, as compared with the standard equipment not having the cooling device 103, the ambient air of the temperature which is lower by approx. 5-10° C. is fed into the main assembly of the apparatus 101, and therefore, the ambient air tends to go downward in the main assembly of the apparatus 101. Thus, the air of the low temperature supplied from the suction opening 109 disposed above the image forming portion is fed to the main assembly of the image forming apparatus, so that the high density cool air tends to move downwardly. Therefore, the ventilation efficiency is high because of natural convection.

On the other hand, the main assembly of the apparatus 101 is provided with an exhaust fan 105 as exhausting means disposed at the same level or below the image forming portions Py, Pm, Pc, Pb. In this embodiment, the exhaust fan 105 is disposed at a rear part of the main assembly of the apparatus 101 in the neighborhood of a lower part of the first image forming portion Py which is disposed opposite the suction fan 104 as the air supply means with the image forming portions Py, Pm, Pc, Pb therebetween. The exhaust fan 105 discharges the air having flown through the gaps between the image forming portions Py, Pm, Pc, Pb to the outside of the main assembly of the apparatus 101.

As described hereinbefore, in this embodiment, the air supply fan 104 is disposed at a position remotest from the fixing device 15, and the exhaust fan 105 is disposed adjacent to the fixing device 15. As described hereinbefore, in this embodiment, there is provided an additional fan, that is, a heat removing fan 106 as heat removing means for discharging the heat from the fixing device 15 to the outside of the main assembly of the apparatus 101.

According to the supply and exhaust system described above, the air flow around the image forming portion P is directed from the fourth image forming portion Pb to the first image forming portion Py and from the front side to the rear side. By doing so, the heat of the fixing device 15 is not easily imparted to the image forming portions P.

5. Structures of Cooling Device, Air Supply Fan Exhaust Fan and Heat Removing Fan:

The cooling device 102, the air supply fan 104, the exhaust fan 105 and the heat removing fan 106 will be described in more detail.

Figure 7:
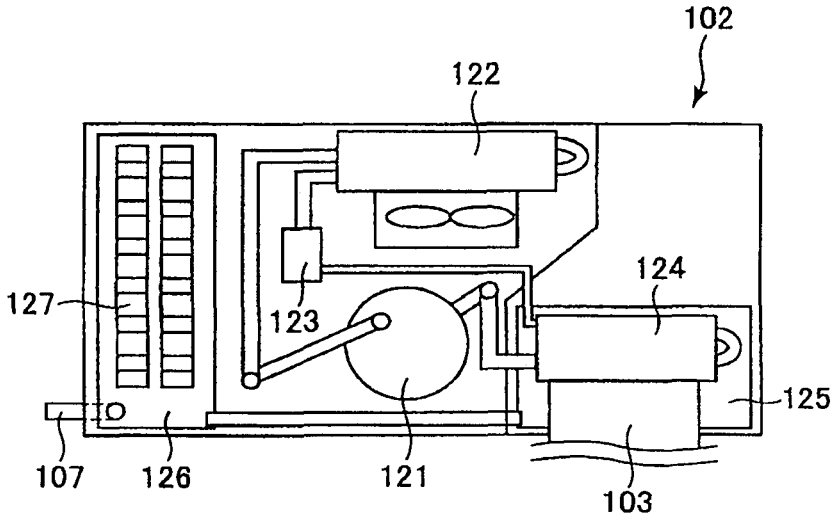
FIG. 7 is a schematic view schematically illustrating the cooling device mounted to the image forming apparatus in this embodiment.

FIG. 7 shows schematically a structure of the cooling device 102. In this embodiment, the cooling device 102 uses heat of evaporation. The cooling device 102 comprises mainly a compressor, 121, a condenser 122, a dryer 123, an evaporator 124.

The mechanism of the cooling device 102 will be described. The coolant is compressed by the compressor 121 into a high temperature and high pressure state. The high temperature and high pressure coolant loses heat in the condenser 122 so that the temperature lowers in the state in which that is, coolant evaporates in the low temperature state, and at this time it deprive the heat (of evaporation) of the neighborhood thereof. Thus, the cool air is generated. The ambient air is cooled when passing around the evaporator 124. The cool air is supplied into the main assembly of the apparatus 101 by the air supply fan 104 through the connection duct 103.

At the outlet portion of the cooling device 102, a fan is ordinarily provided. In this embodiment, the main assembly of the apparatus 101 is provided with air supply means 104, and therefore, the fan is omitted at the outlet portion of the cooling device 102. In this embodiment, the entering of the ambient air from the cooling device 102 into the main assembly of the apparatus 101 when the cooling device 102 is mounted to the air supply opening 109 is promoted only by the air supply means 104 provided in the main assembly of the apparatus 102. This is effective to reduce the cost, and the cooling device 102 can be downsized. If desired, however, the fan may be provided at the outlet portion of the cooling device 102.

In this embodiment, the power of the cooling device 102 is about 500 W, and is about 150 W at the rated power of the compressor. The coolant in this embodiment is HFC which is a chlorofluorocarbon substitute, more particularly, R134a.

In this embodiment, the air supply means 104 includes two 120 mm square axial fans. The air flow rate of the air supply means 104 is approx. 1-3 $m^3$ per minute. The air supply means 104 supplies the air having a temperature lower than the ambient air by approx. 5-10° C. provided by the cooling device 102.

In this embodiment, the exhausting means 105 include one 120 mm square axial fan, and the heat removing means 106 includes two 120 mm square axial fans. The air flow rate of the exhausting means 105 and the heat removing means 106 are approx. 0.5-1.5 $m^3$ per minute and approx. 1-3 $m^3$ per minute, respectively.

In this embodiment, the cooling device 102 is disposed above the image forming portions P, and therefore, the cool air flows efficiently and smoothly to around the image forming portion P in the main assembly of the apparatus 101 with the aid of the gravity. In addition, the air supply means 104 is remotest from the fixing device 15 in the main assembly of the apparatus 101, and the exhausting means 105 is adjacent to the fixing device 15, and therefore, the temperature rise around the image forming portion P can be efficiently suppressed without transferring the heat from the fixing device 15 toward the image forming portion P.

6. Drainage Device:

The processing of the drain produced by the cooling device 102 will be described.

As shown in FIG. 6, in the option device, the main assembly of the apparatus 101 is provided with a drainage device 108 for disposal of the drain water discharged from the cooling device 102. The drainage device 108 is disposed at the backside of the main assembly of the apparatus 101, more particularly, the backside of the fixing device 15. The drainage device 108 is detachably mountable relative to main assembly of the apparatus 101, and in the drainage device 108, it is not mounted to the main assembly of the apparatus 101.

Referring to FIG. 7, when the ambient air passes by the evaporator 124 in the cooling device 102, the air is cooled with the result of dew condensation of the water content contained in the ambient air on the surface of the evaporator 124. The dew condensation water falls on a drain pan provided below the evaporator 124 and is fed to an evaporation pan 126. Above the evaporation pan 126, an evaporation sheet 127 is provided. A part of the water supplied to the evaporation pan 126 is evaporated by blowing the warm air to the evaporation sheet 127 by a fan (not shown) utilizing the heat generated by the compressor 121 and the condenser 122. The water not evaporated but remains there is fed to a drainage device 108 through drain pipe 107.

Figure 8:
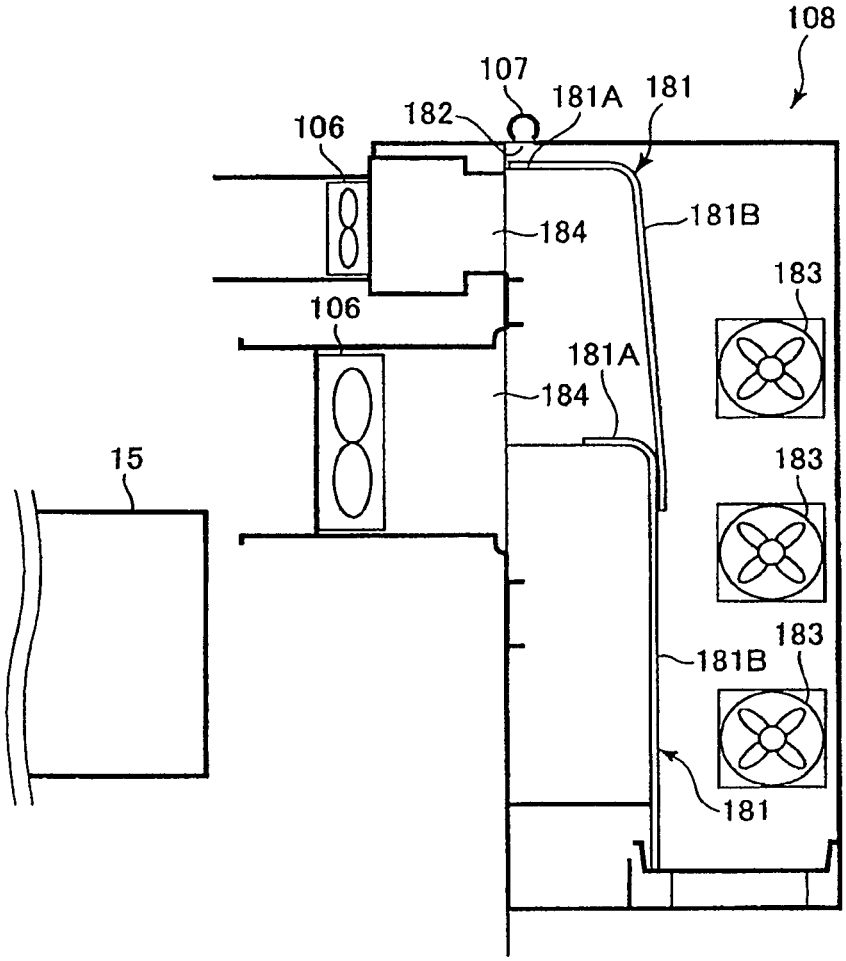
FIG. 8 is a schematic view schematically illustrating a structure of the drainage device mounted to the image forming apparatus according to an embodiment of the present invention.

FIG. 8 show a structure of the drainage device 108. In the drainage device 108, two water absorbing members 181 of felt-like material capable of water absorbing water, which are bent to an L shape, are provided in two stages. The water fed from the cooling device 102 through the drain pipe 107 falls from an opening 182 provided in the connecting portion between the drain pipe 107 and the drainage device 108. The water moves slowly in the water absorbing member 181 by the capillary phenomenon-along the length 181B of the L shaped portion. The water passed through the water absorbing member 181 is received by the lower water absorbing member 181 contacted to the water absorbing member 181 and moves further down.

The drainage device 108 is disposed outside the heat removing means 106 of the fixing device 15 The air discharged from the inside of the main assembly of the apparatus 101 by the heat removing means 106 is blown to the water absorbing member 181 through an opening 184 provided in the connecting portion between the drainage device 108 and the heat removing means 106 The air is warmed by the heat from the fixing device 15 By blowing the high temperature air to the water absorbing member 181, the water content in the water absorbing member 181 evaporates, and is discharged to the outside of the drainage device 108 by an exhaust fan 183 provided in the drainage device 108.

In this embodiment, a heat removing means 106 is provided for the fixing device 15, in addition to the exhausting means 105, and the drainage device 108 uses the air discharged from the inside of the main assembly of the apparatus 101 by the heat removing means 106 to evaporate the drain water coming from the cooling device 102. By doing so, the waste heat from the fixing device 15 can be efficiently used to evaporate the drain water from the cooling device 102, while maintaining the smooth air flow for cooling the image forming portion P. However, if desired, only the exhausting means 105 may be provided so as to evaporate the drain water from the cooling device 102 by the air discharged from the inside of the main assembly of the apparatus 101 using the exhausting means 105.

Conventionally, when the image forming apparatus is equipped with a cooling device, a relatively high cost is required for the drainage facilities, or a waste water container has to be provided resulting in cumbersome exchange. According to this embodiment, the image forming apparatus 100 per se is equipped with the drainage device 108, by which the drainage facilities or installation of the waste water container are not necessary. In addition, the drainage device 108 of this embodiment utilizes the waste heat of the fixing device 15, a heat recycling is established.

7. Effect:

In this embodiment, the air supply opening 109 is common to the standard equipment and the option device, and the air flow in the main assembly of the apparatus 101 is also common. Therefore, the user can easily add the cooling device 102 to the image forming apparatus 100 as desired, even after the installation of the image forming apparatus 100, without the necessity of modification for change of the air flow. When the cooling device 102 is mounted, the drainage device 108 for disposing the drain produced by the cooling device 102 can be added to the image forming apparatus 100.

An example of the apparatus using the embodiment will be described. For example, in the case of the option device, that is, the cooling device 102 is installed, the temperature of the cool air supplied into the main assembly of the apparatus 101 is lower by approx. 5-10° C. than the ambient air around the image forming apparatus 100. Therefore, the developer temperature is kept lower than 40° C. even if the image forming-apparatus 100 is continuously operated for a long term. However, in the case of the standard equipment without the cooling device 102, the ambient air is supplied into the main assembly of the apparatus 101 without cooling. Then, the temperature of the developer can be maintained lower than 40° C. for a short term, approx. one hour, for example, but in a long term continuous operation such as several hours, the temperature may rise to about 45° C. at the maximum. In the case of such temperature rise, deterioration of the developer may be enhanced with the result of, reduction of lifetime of the developer.

In order to avoid this, it is desirable to install the cooling device 102, but the installation of the cooling device 102 and the drainage device 108 requires a considerable cost. For this reason, such installation will be desirable for the user operating the apparatus for a long term, but for the user not operating it for a long term, the cooling device 102 installation is too much.

According to this embodiment, the cooling device 102 can be mounted and demounted easily without changing the air flow in the main assembly of the apparatus 101, and therefore, the installation of the cooling device 102 is selectable depending on the usage. Thus, for the users operating the apparatus for a short term in most cases, the present invention can provide an apparatus without the cooling device 102 with the advantages of low cost, low electric energy consumption and simple structure. On the other hand, for the users operating the apparatus for a long term in many occasions, the present invention can provide an apparatus with the cooling device 102 which enables long stable term operation. In addition, the user having installed without cooling device 102 changes the usage to operate the apparatus for a long term in many cases, the cooling device 102 can be easily added.

As described in the foregoing, according to this embodiment, the installation of the cooling device 102 can be easily added substantially without changing the air flow in the main assembly of the apparatus 101, and the inside of the main assembly of the apparatus can be effectively cooled with the desired cooling power. According to this embodiment, the air supply opening 109 and the air supply means 104 is disposed above the image forming portion P. By doing so, irrespective of use of a small size cooling device 102 (small size compressor), the entirety of the image forming portions P can be efficiently cooled. Then, the temperature around the image forming portions is stabilized, and therefore, the deterioration of the developer is suppressed, so that the images can be stably formed in long term use. In addition, by positioning the cooling device 102 above the image forming portion P, by which the drain water from the cooling device 102 can be smoothly introduced to the drainage device 108 using the gravity.

Embodiment 2

Another embodiment of the present invention will be described. The fundamental structures and operations of the image forming apparatus of this embodiment are the same as those of Embodiment 1. Therefore, in the description of this embodiment, the same reference numerals as in Embodiment 1 are assigned to the elements having the corresponding functions in this embodiment, and the detailed description thereof is omitted for simplicity.

In this embodiment, there is provided temperature sensors 20*y*, 20*m*, 20*c*, 20*b* as temperature detecting means for detecting temperatures of the developers, in the developing devices 4*y*, 4*m*, 4*c*, 4*b*. When the optional cooling device 102 is mounted to the air supply opening 109, a controller 19 controls ON/OFF of the cooling device 102 in response to the detection result of the temperature sensors 20*y*, 20*m*, 20*c*, 20*b*. Also, the controller 19 controls various fans including a suction fan 106 provided in the main assembly side of the image forming apparatus.

More particularly, in the photosensitive drum 1, there is provided a heater (not shown) to maintain the temperature of the surface of the photosensitive drum 1 at a predetermined temperature. If the temperature of the surface of the photosensitive drum 1 is too low, the moisture may due on the surface thereof with the result of image defect such as flow of the image. In this embodiment, the temperature of the surface of the photosensitive drum 1 is controlled to be between approx. 35-40° C., by the heater.

On the other hand, for the developer in the developing device 4, a large temperature change is not preferable since then the properties of the developer is not stable, and in addition, in view of the deterioration of the developer per se, high temperature is not preferable. Particularly, if the temperature of the developer exceeds 40° C., the deterioration speed of the developer tends to abruptly rises. In addition, if the developer temperature exceeds 45° C., the flowability of the developer becomes worse, a feeding defect of the developer such as clogging of the feeding path may result. Such limit temperatures are different depending on the kinds of the developer, and recently, low temperature fixing developers increase, and therefore, the kinds of the developers with which the high temperature is not preferable increase. Under the circumstances, the temperature of the developer is preferably controlled between approx. 30-40° C.

Figure 9:
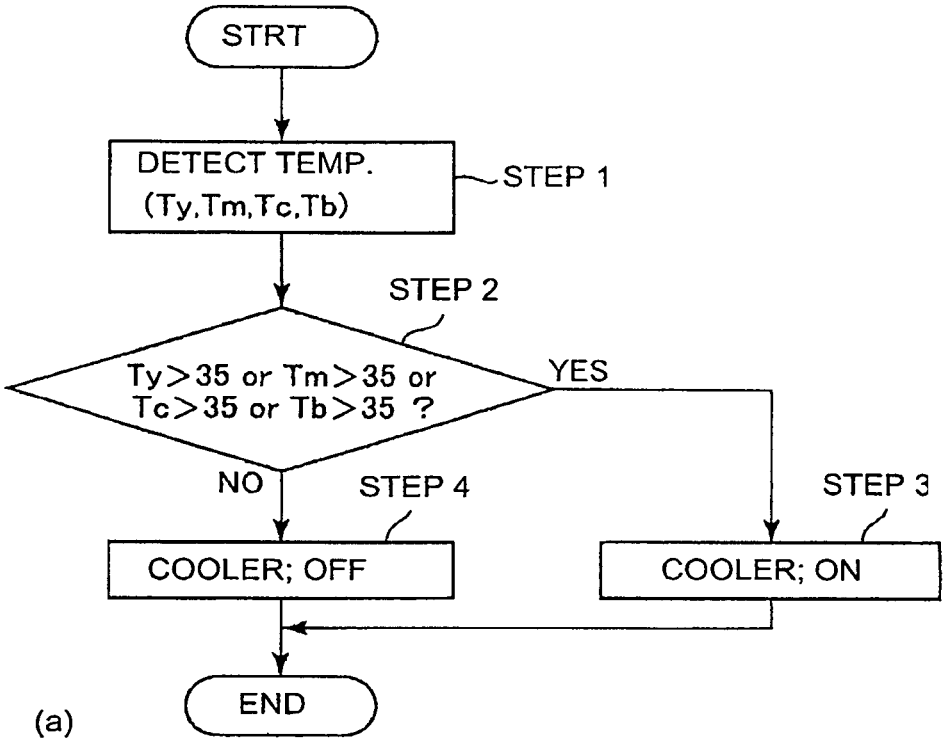
FIG. 9 is a flow chart of an ON/OFF control system for the cooling device according to another embodiment of the present invention.
Figure 9:
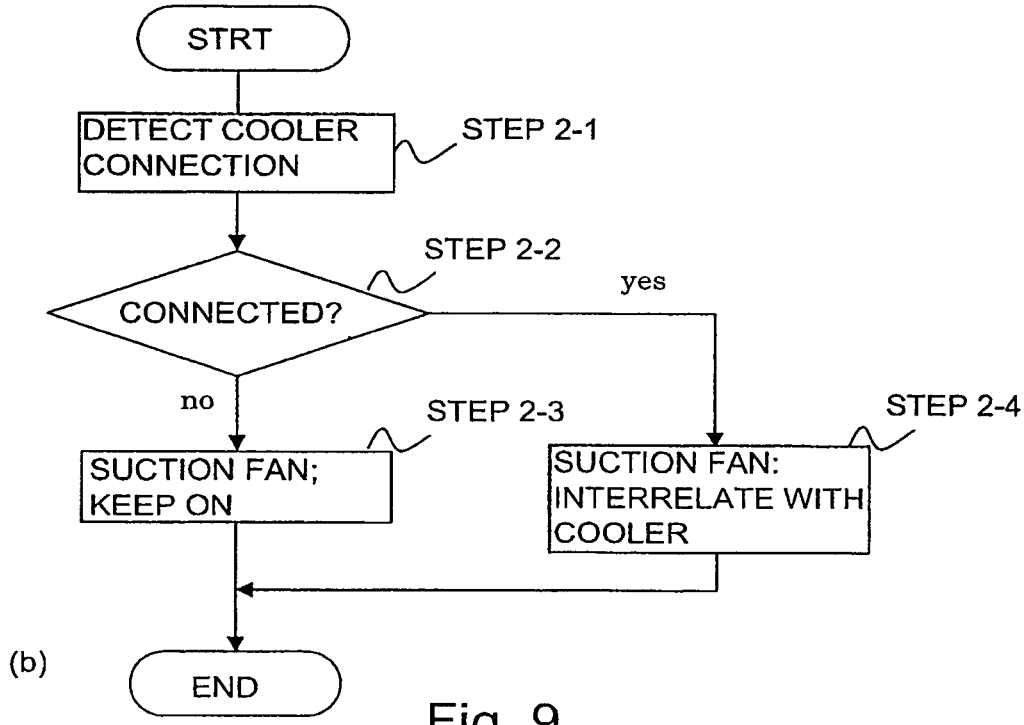
Figure 10:
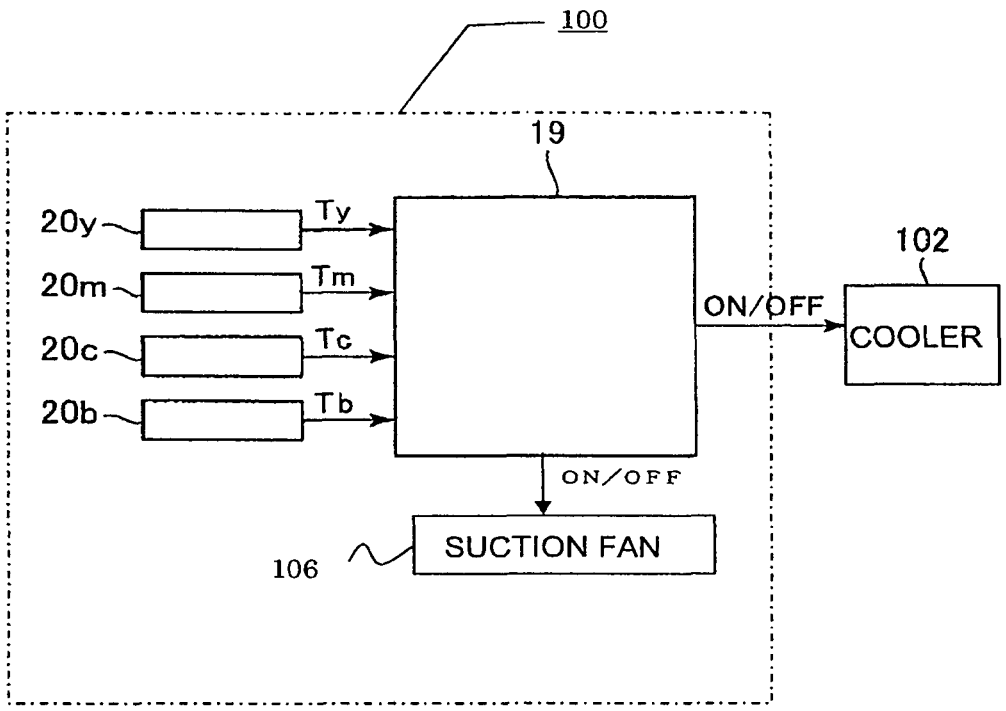
FIG. 10 is a block diagram illustrating an ON/OFF control operation of the cooling device according to another embodiment of the present invention.

FIG. 9 is a flow chart of control in this embodiment. FIG. 10 is a control block diagram in this embodiment.

The controller 19 as a control device of the image forming apparatus 100 controls various parts of the image forming apparatus in the process shown in the flow chart of part (a) of FIG. 9. When the main switch of the image forming apparatus 100 is turned on, the controller 19 reads the information of the developer temperatures Ty, Tm, Tc, Tb in the developing devices 4*y*, 4*m*, 4*c* and 4*b*, indicated by the detection results of the temperature sensors 20*y*, 20*m*, 20*c*, 20*b* (step 1). The controller 19 renders the cooling device 102 on (steps 2, 3) when one of the developer temperatures Ty, Tm, Tc, Tb in the developing devices 4*y*, 4*m*, 4*c*, 4*b* exceeds. The controller 19 renders the cooling device 102 OFF (steps 2, 4) when all of the developer temperatures Ty, Tm, Tc, Tb in the developing devices 4*y*, 4*m*, 4*c*, 4*b* become not more than 35° C.

Furthermore, the controller 19 switches the operations of the respective portions depending on whether or not the main assembly of the apparatus is provided with cooling device. Part (b) of FIG. 9 is a flow chart showing the control depending on whether or not the cooling device is mounted to the device. The controller 19 detects whether or not the cooling device is mounted to the main assembly of the apparatus (step 2-1). The mounting of the cooling device is inputted on an operating portion such as a touch panel of the main assembly of the apparatus by a service person. Alternatively, a projection is provided only on the cover for the suction opening not on the cooling device, and the mounting of the cooling device is discriminated when the projection is not detected.

Subsequently, when the controller discriminates the mounting of the cooling device on the basis of the information obtained in step 2-1, the operation goes to step 2-4.

If not, the operation goes to step 2-3 (step 2-2). When the cooling device is mounted to the main assembly of the apparatus, the suction fan is operated in interrelation with the operation of the cooling device (step 2-4). When the cooling device is not mounted to the main assembly of the apparatus, the controller continues the operation of the suction fan (step 2-3) irrespective of the output of the temperature sensor.

During stand-by state in which the image forming apparatus 100 waits for start instructions for image formation after the main switch actuation, the cooling device 102 is kept OFF, and only the air supply means 104 is operated, and the ambient air is supplied into the main assembly of the apparatus 101 without cooling. During the stand-by state, except of the period immediately after an end of the image forming operation, the supply of the ambient air without cooling is enough to maintain the temperature around the image forming portion P including the developing device 4 within the predetermined temperature range, that is, approx. 30-40° C. for the developing device 4, and approx. 35-40° C. for the photosensitive drum 1.

In this embodiment, as described hereinbefore, the cooling device 102 is ON/OFF-controlled depending on whether or not the developer temperature is not more than 35° C. This is because the self-temperature-rise of the developing device 4 is taken into account. More particularly, when the developing device 4 is operated, the temperature of the developer rises by friction with the developing sleeve and the feeding screw by about 3-5° C. For this reason, the start of the cooling of the cooling device 102 after the temperature of the developer reaches about 40° C. may be too late. However, these values are typical examples and are not limiting to the present invention.

As described in the foregoing, according to the control of the present invention, the temperature of the developer can be maintained in the preferable range (30-40° C., for example). Therefore, according to this embodiment, the energy saving is accomplished, and the coloring (density) is stable, image defect such as foggy image or stripe image can be prevented, for a long term, and the lifetime of the developer can be prolonged.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 192813/2010 and 179806/2011 filed Aug. 30, 2010 and Aug. 19, 2011, respectively, which are hereby incorporated by reference.

What is claimed is:

1. An image forming apparatus comprising: a main assembly;

an image forming portion, provided in said main assembly, for forming a toner image using an electrophotographic process;

an air supply opening, provided in the main assembly, for fluid communication between an inside and an outside of said main assembly;

an air supply device, provided in said main assembly, for supplying ambient air into said main assembly through the air supply opening;

an exhausting device, provided in said main assembly, for discharging air from inside of said main assembly;

a mounting portion for selectively mounting, to the air supply opening, one of a cooling device for taking the ambient air in and for decreasing a temperature of the air taken in, and a cover for partly blocking the air supply opening and forming an air passage portion, wherein when said cooling device is mounted to said mounting portion, said air supply device supplies the air cooled by said cooling device into said main assembly, and when said cover is mounted to said mounting portion, said air supply device supplies the ambient air directly into said main assembly through the air passage portion of said cover;

a detecting device for detecting a temperature around the image forming portion; and a controller for controlling air supply to the air supply opening, such that when said cooling device is not mounted to said mounting portion, said control device continues air supply from the air supply opening irrespective of the detection result of said detecting device, and when said cooling device is mounted to said mounting portion, said control device controls on and off of said cooling device on the basis of an output of said detecting device, and on and off of the supplied air from the air supply opening in interrelation with said cooling device.

2. An apparatus according to claim 1, wherein a flow path of the air from said air supply device to said exhausting device in said main assembly is the same irrespective of whether or not said cooling device or said cover is mounted to the air supply opening.

3. An apparatus according to claim 1, wherein flow of the air from said cooling device into said main assembly is promoted only by said air supply device provided in said main assembly, when said cooling device is mounted to the air supply opening.

4. An apparatus according to claim 1, wherein said detecting device is disposed in a developing device provided in said image forming portion.

5. An apparatus according to claim 1, wherein when said cooling device is mounted to the air supply opening, a drainage device, for evaporating drain water from said cooling device using the air discharged from the inside of said main assembly apparatus, is mounted to said main assembly.

6. An apparatus according to claim 5, wherein said drainage device evaporates the drain water by the air warmed by a fixing device and supplied by a heat removing device.

* * * * *